US005138843A

United States Patent [19]

Tamayama et al.

[11] Patent Number: 5,138,843

[45] Date of Patent: Aug. 18, 1992

[54] METHOD FOR OPERATING AN OPEN SHOW-CASE

[75] Inventors: Hiroshi Tamayama, Gunma; Tetsuo Nakamura, Saitama; Katsumi Ogino, Gunma, all of Japan

[73] Assignee: Sanyo Electric Co., Ltd., Osaka, Japan

[21] Appl. No.: 754,134

[22] Filed: Sep. 3, 1991

[30] Foreign Application Priority Data

Sep. 4, 1990 [JP] Japan ..... 2-235168

[51] Int. Cl.[5] ..... A47F 3/04

[52] U.S. Cl. ..... 62/82; 62/256

[58] Field of Search ..... 62/256, 82, 234, 282

[56] References Cited

U.S. PATENT DOCUMENTS

| | | | |
|---|---|---|---|
| 4,341,082 | 7/1982 | Ibrahimi | 62/256 X |
| 4,439,992 | 4/1984 | Ibrahimi | 62/256 X |
| 4,514,988 | 5/1985 | Ibrahimi | 62/256 X |
| 4,633,677 | 1/1987 | Maehara | 62/256 |
| 4,644,758 | 2/1987 | Maehara et al. | 62/256 X |
| 4,648,247 | 3/1987 | Takiyama et al. | 62/256 |
| 4,691,527 | 9/1987 | Ikeda | 62/256 X |
| 4,741,171 | 5/1988 | Toshiyuki | 62/256 X |

*Primary Examiner*—William E. Tapolcai
*Attorney, Agent, or Firm*—Darby & Darby

[57] ABSTRACT

This open show-case has inner and outer air ducts, a first evaporator and a first blower in said inner duct (an inner evaporator and an inner blower, respectively), and a second evaporator and a second blower in said outer duct, said blowers circulating the air to form at least two layers of air curtains running between respective upper ports at the upper end of the front opening of said show-case and respective lower ports at the lower end of said opening. The show-case is operated by: providing high pressure refrigerant only through the inner evaporator via a decompression valve to thereby evaporate the refrigerant therein during refrigeration operation by the inner evaporator, without passing the refrigerant through the outer evaporator; and providing high pressure refrigerant to the inner evaporator and to the outer evaporator via a decompression valve during defrosting operation for the inner evaporator, with the outer blower driven at a higher speed than a normal speed and the inner blower driven in a reverse direction at a slower speed than a normal speed.

4 Claims, 4 Drawing Sheets

METHOD FOR OPERATING AN OPEN SHOW-CASE

FIELD OF THE INVENTION

The invention relates to a method for operating an open show-case which comprises pairs of an evaporator and a blower, one for each of inner and outer air ducts.

BACKGROUND OF THE INVENTION

As shown in Japanese Patent Early Publication 57-23773, a typical open show-case having an inner and an outer air ducts provided independently in an inner and an outer boxes, respectively, of the show-case includes two pairs of an evaporator and a blower, one for each duct for circulating for desired refrigeration of the foods in a storage chamber.

In a refrigeration system including such evaporators there are provided, along with decompression elements connected with the evaporators, switching means for selecting the operative evaporators.

Usually, such switching means as mentioned above periodically switches the passage of the refrigerant such that the two evaporators alternately functions to cool the show-case while the remaining one is subjected to defrosting operation.

For example, in order to perform refrigeration by a first evaporator or the evaporator for the inner duct while defrosting a second evaporator or the evaporator for the outer duct, refrigerant is passed through the second non-operating evaporator to provide the sensible heat of the refrigerant to the second evaporator to melt the frost thereon. While passing through the second evaporator, the refrigerant is super-cooled, which is then passed through a first decompression element of the first evaporator, where the refrigerant is evaporated. In the opposite case where the refrigeration is performed by the second evaporator while defrosting the first evaporator, the passage of the refrigerant is switched so that it is first passed through the first evaporator, and the super-cooled refrigerant is then passed through the second evaporator.

The prior art system as mentioned above, however, has a disadvantage in that during refrigeration by one evaporator the other must be constantly supplied with refrigerant having temperature in the range of 30°-35° C. This results in cold air in one duct and warm air in the other duct, the latter air having temperature normally warmer than ambient air temperature. This is also the case in a double layered air curtain formed across the front opening of the show-case. That is, one layer of the air curtain has a higher temperature and the other lower temperature than the ambient air. Consequently, both of them are "neuteralized" in temperature, so that the temperature of the air curtain remains in the neighborhood of 10° C., which is considerably higher than desired cooling temperature of 0° C. (or less) in the storage chamber.

This problem is serious particularly when the second evaporator (for the inner duct) is undergoing defrosting, since then such a warm air curtain (warmer than the ambient air) is formed inside the cold air curtain, causing the temperature of the storage chamber to rise appreciably than desirable refrigeration temperature.

BRIEF SUMMARY OF THE INVENTION

Thus, it is an object of the invention to provide an open show-case which may sustain the storage chamber at substantially constant proper temperature for all of the cycles of the system.

In particular, the invention provides a method for operating an open show-case having inner and outer air ducts, a first evaporator and a first blower in said inner duct (an inner evaporator and an inner blower, respectively), and a second evaporator and a second blower in said outer duct (an outer evaporator and an outer blower), said blowers circulating the air to form at least two layers of air curtains between respective upper ports at the upper end of the front opening of said show-case and respective lower ports at the lower end of said opening, comprising steps of: providing high pressure refrigerant only through an inner evaporator via a decompression valve to thereby evaporate the refrigerant therein during refrigeration operation by the inner evaporator; and, during defrosting operation for the inner evaporator, providing high pressure refrigerant to the inner evaporator and to the outer evaporator via a decompression valve, with the outer blower driven at a higher speed than a normal speed and the inner blower driven in a reverse direction at a slower speed than a normal speed.

With this arrangement a cold air curtain to be formed during the refrigeration operation will not be formed during defrosting operation. Instead, a protective air curtain is formed on top of the cool air curtain covering the storage chamber, said protective curtain running in the opposite direction with nearly the same speed as the cold air curtain to be formed during the refrigeration operation. It should be appreciated that the protective air curtain prevents the warm ambient air from infiltrating into the refrigeration chamber, contributing to maintain the temperature in the chamber always constant. It should be also appreciated that on account of the reversion of the inner air curtain, the protective air curtain is partly taken into the outlet port which serves as an inlet for the now reversed inner air curtain. The combined air flow goes through the inner duct and passes over the wet inner evaporator, thereby dehydrating the inner evaporator in defrosting operation. At the same time part of the warm inner air curtain coming out of the lower inlet port (which is now serving as an outlet for the reversed inner air curtain) is sucked into the outlet port, so that it does not enter the storage room. This also helps prevent said "neutralization" of the curtain and maintain the temperature of the chamber constant.

DETAILED DESCRIPTION OF THE PREFERRED EMBODIMENT

Figure 1:
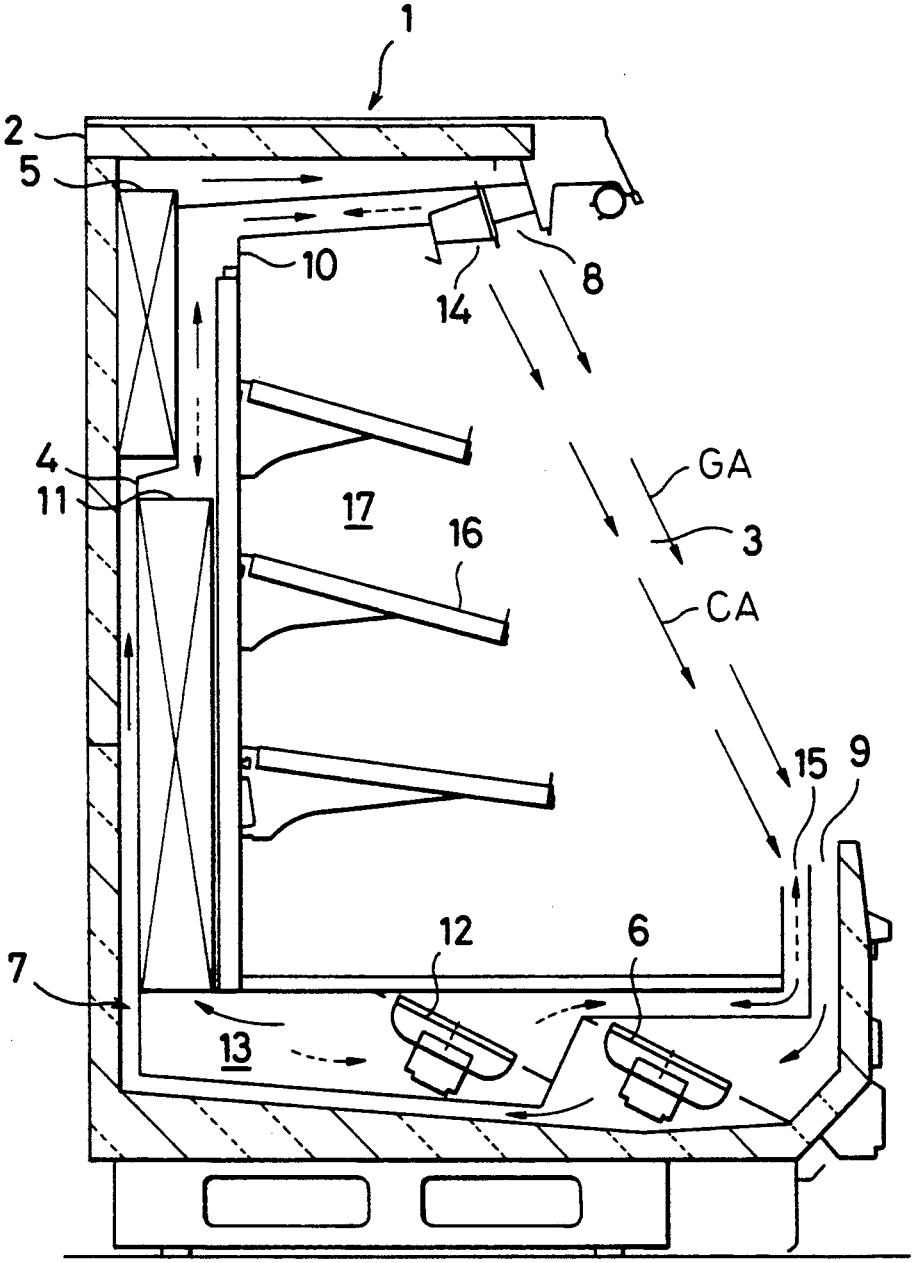
FIG. 1 is a cross sectional elevation of a preferred embodiment of an open show-case according to the invention.

Referring now to DFIG. 1, there is provided an open show-case 1 including a thermally insulating wall 2 having therein a front opening 3 for access to merchandise stored in the refrigeration chamber 17. The show-case is provided with a first panel 4 which is made of a thermally insulating material and arranged inside, but appropriately spaced apart from, the insulating wall 2. The space between the wall 2 and the panel 4 forms an outer air passage of outer duct 7. In the outer air passage 7 are an evaporator 5 (referred to as outer evaporator) for a first air curtain or outer air curtain GA covering the front opening 3, an axial blower 6 associated with the evaporator 5. An outer air outlet 8 is located a long the upper edge of the opening 3 and an outer air inlet 9 is located along the lower edge of the opening 3, facing the outlet 8. A second metal partition panel 10, separated from the first partition panel 4, is provided further inside the first partition panel to form the upper, lower, and rear wall of the refrigeration chamber 17. The space between the two partition panels forms an inner air passage or inner duct 13. The inner air passage includes therein a plate fin type evaporator 11 (referred to as inner evaporator) and another axial blower 12 provided specifically for the inner air passage. The inner air duct has its air outlet port 14 and air inlet part 15 along the upper and lower edges of the opening 3, respectively, inside the outlet 8 and inlet 9 for the outer air duct. The ports 14 and 15 also face each other.

Figure 2:
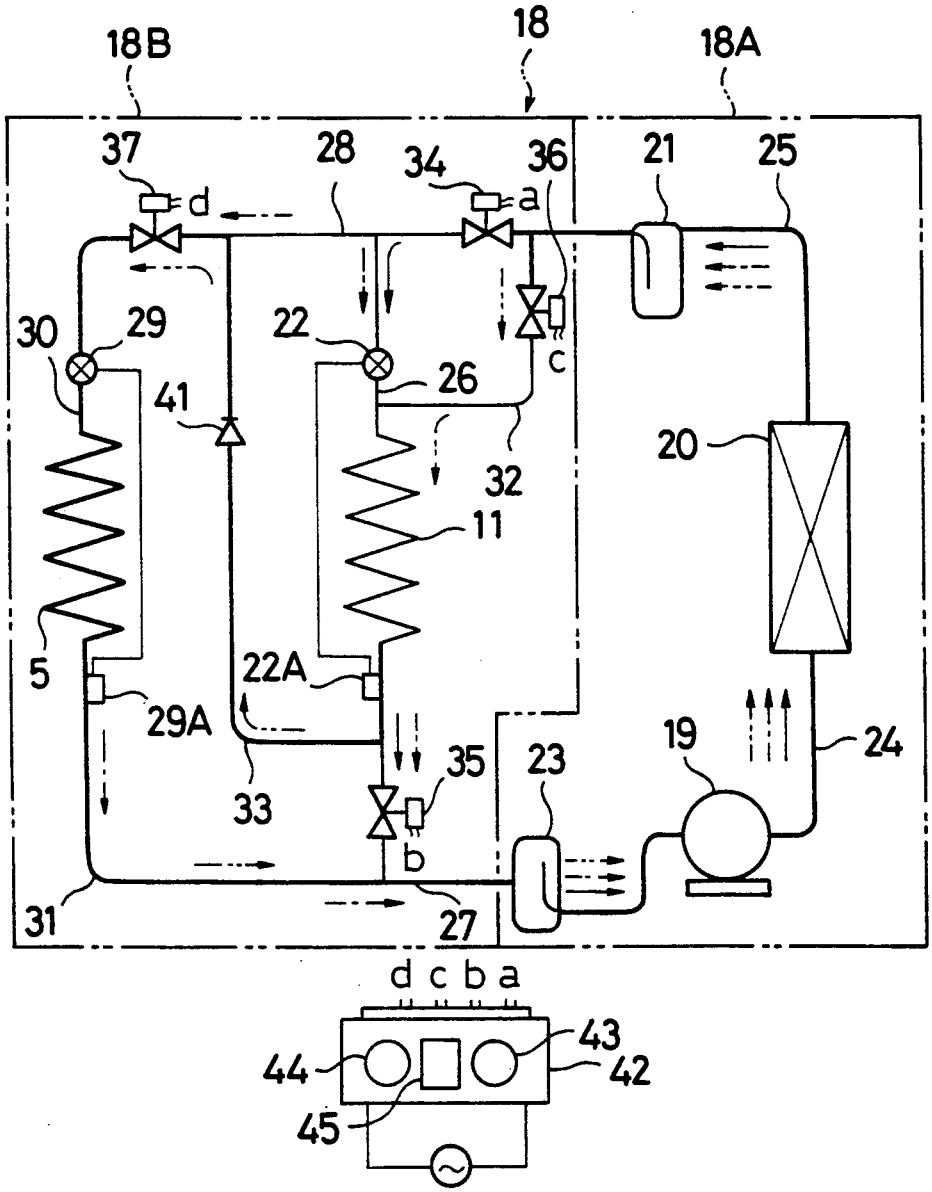
FIG. 2 is a diagram of a refrigerant circuit for use with the open show-case of FIG. 1.

Referring now to FIG. 2, there is provided a refrigerant circuit 18 for a refrigeration system for use with the open show-case 1 described above. The circuit includes a refegerant compressor 19, a water cooled or air cooled condenser 20 serving as a cold heat source, a liquid receiver 21, a decompression valve 22 associated with a temperature sensor 22A and an expansion valve, the evaporator 11 for the inner duct, a gas-liquid separator 23, a high pressure gas pipe 24, a high pressure liquid pipe 25, a first low pressure liquid pipe 26, and a low pressure gas pipe 27, all connected in a loop to form a closed refrigeration circuit. The high pressure liquid pipe 25 is bifurcated to a high pressure liquid branch pipe 28 of a branch circuit including the outer evaporator 5. The branch circuit further comprises, a temperature sensor 29A, a decompression valve 29 having an expansion valve, a second low pressure liquid pipe 30, and a low pressure gas branch pipe 31 connected to the low pressure gas pipe 27 to complete the branch circuit. Thus, the outer evaporator 5 is connected with the inner evaporator in parallel relationship.

A pipe 32 is a by-pass provided for leading the high pressure refrigerant to the inner evaporator 11 in defrosting operation so as to provide sensible heat to defrost the evaporator 11. The by-pass is connected at one end thereof to the a portion of the high pressure liquid pip 25 between the liquid receiver 21 and the decompression device 22, and at the other end to a portion of the low pressure liquid pipe 26.

A communication pipe 33 is provided for leading the high pressure liquid from the inner evaporator 11 to the outer evaporator 5 during defrosting period. The pipe 33 is connected at one end thereof to a portion of the lower pressure pipe 27 between the inner evaporator and the gas-liquid separator 23, and at the other end to a portion of the high pressure liquid branch pipe 28.

A first, a second, a third, and a fourth electromagnetic valves 34 through 37, respectively are provided for switching the routes of the refrigerant as required. Specifically, the first electromagnetic valve 34 is provided in the high pressure liquid pipe 25 between the decompression valve 22 and the liquid receiver 21. The valve 34 is opened during the refrigeration operation by the inner evaporator 11 and the refrigeration operation by the inner and outer evaporator 11 and 5, respectively. The valve 34 is, however, closed during defrosting operation of the inner evaporator 11 and during pump down operation. The second electromagnetic valve 35 is provided in the lower pressure branch pipe 27 between the entrance of the communication pipe 33 and the exit of the low pressure gas branch pipe 31. This valve 35 is operated in the same manner as the first valve 34. The third electromagnetic valve 36 is provided in the by-pass pipe 32, and is opened only during the defrosting operation of the inner evaporator 11. The fourth electromagnetic valve 37 is provided in the high pressure liquid branch pipe 28 between the exit of the communication pipe 33 and the decompression valve 29. This valve 37 is always opened except for during the refrigeration operation of the inner evaporator 11.

A check valve 41 is provided in the communication pipe 33, for preventing the high pressure liquid refrigerant in the high pressure liquid pipe 25 and the high pressure liquid branch pipe 28 from flowing into the low pressure gas pipe 27 during refrigeration operation by the outer evaporator 5 and/or the inner evaporator 11.

The portion of the refrigeration circuit 18, shown by a double dotted chain block 18A, constitutes a condensation unit, which may be installed in a machinery room separately from the portion shown by a double dotted chain block 18B which constitutes a refrigeration unit installed in a shop.

A controller 42 controls the operation of the electromagnetic valves 34–37 by actuating them for predetermined periods of time based on a timer 43 in the controller 42. The controller 42 may be a microcomputer and has output terminals (a) through (d) to be connected to the valves. The controller 42 also contains a first and second speed control circuits 44 and 45, respectively, for controlling the operation of the inner and outer blowers 12 and 6, respectively. The first speed controller 44 may stop the inner blower 12 or actuate it in the reverse direction during defrosting operation of the inner evaporator 11. The second speed controller 45 may operate the outer blower 6 faster during defrosting operation of the inner evaporator 11 than during refrigeration operation by the inner evaporator 11.

Referring now to a timing chart shown in FIG. 3, the refrigeration and defrosting operations of the open show-case 1 will be now described below.

In a first mode of refrigeration the first and second electromagnetic valves 34 and 35 are opened, while the third and fourth electromagnetic valves 36 and 37 are closed. Under this condition the compressor 19 is driven to circulate liquified high pressure refrigerant through the first refrigeration circuit, in which the refrigerant flows from the compressor 19 to the condenser 20, the liquid receiver 21, and, through the first electromagneticc valve 34, to the decompression valve 22 and the evaporator 11, and further through the second electromagnetic valve 35 to the gas-liquid separator 23, and back to the compressor 19. This mode may be sustained for a predetermined period, for example 4 hours, with the inner blower 12 circulating the air in the inner duct 13 so that the air gives off heat to the inner evaporator 11 as it passes over the evaporator 11. In a preferred embodiment the temperature of the refrigerant or the evaporator is in the neighborhood of −20° C. so that the air gets cooled to about −10° C. The cold air thus produced is delivered from the air outlet 14 to from an air curtain CA over the front opening 3 of the show-case 1, as shown by solid arrows in FIG. 1. The air curtain has a speed of 1.3 m/sec and cools the storage chamber 17 at about −4° C. This temperature is desirable to preserve foods in the chamber at −2° C., say, in a condition that cells of the foods may be kept alive. During this operation the first and the second valves 34 and 35, respectively, simultaneously opened and closed repeatedly based on the temperature detected by a monitor in the storage chamber 17 to maintain the chamber within a proper temperature range. On the other hand, the air in the outer duct 7 is circulated by the outer blower 6 and form another air curtain GA over or outside the cold inner curtain CA, as shown by solid arrows in FIG. 1. The outer curtain GA has a speed of about 0.9 m/sec and has temperature of about 7° C. under the influence of the cold inner curtain CA. The outer curtain acts as a protective curtain, protecting the cold inner curtain from the ambient air.

In the course of refrigeration the inner evaporator 11 accumulates frost thereon. A timer (not shown) provides signals when a predetermined period elapsed for a refrigeration operation. Based upon the signal from this timer, the refrigeration system proceeds to a second mode of refrigeration operation, in which the fourth electromagnetic valve 37 is opened by the controller 42 so as to bifurcate or divert part of the liquid refrigerant into the high pressure liquid branch pipe 28. The deverted refrigerant is decompressed in the decompression valve 29 and allowed to evaporate in the outer evaporator 5, and passes through the low pressure gas branch pipe 31 and subsequent low pressure gas pipe 27, finally merging to the low pressure gas refrigerant that has passed through the inner evaporator 11. Thus, this mode of refrigeration operation uses two evaporators, involving the secondary refrigeration circuit 18B shown in FIG. 1. The second mode of operation is started immediately before the initiation of a defrosting operation and lasts, for example 30 seconds. It should be appreciated that the bifurcation of the refrigerant causes the outer evaporator to lower its temperature (to about −25° C. during evaporation), so that the air in circulation in the outer duct gets cooled to −10° C. or so as it passed over the outer evaporator 5. It should be noted that in this mode the blowers 12 and 6 still maintain their first mode speeds and directions as in the first mode.

After the second mode mentioned above the controller 42 provides signals to initiate a third mode of operation for defrosting the inner evaporator 11. The signals are given to the first, second and the third electromagnetic valves 34, 35 and 36 respectively, to close the valves 34 and 35 and open the valve 36, for defrosting operation. Accordingly the high pressure liquid refrigerant from the liquid receiver 21 by-passes the decompression valve 22 and is led directly to the inner evaporator 11 through a by-pass pipe 32, the communication pipe 33, the fourth electromagnetic valve 37, the decompression valve 29, the outer evaporator 5, the gas liquid separator 23, and to the compressor 19, as indicated by double doted arrows in FIG. 2. This constitutes a third cycle or third mode of operation. The third mode lasts for about 10 minutes to defrost the inner evaporator 11. When the highly pressurized liquid refrigerant (having temperature of about 35° C.) is introduced from the by-pass pipes 32 into the inner evaporator 11 and passed therethrough, the refrigerant becomes super-cooled through heat exchange with the evaporator 11 liberating its energy to the frost on the evaporator 11 circulating the air in the inner duct 13. The final temperature of the refrigerant will be about 5° C. at the exit of the evaporator. The frost is gradually melt.

It is important to note that the third mode operation involves stopping of the inner blower for about 15 second followed by reversion and slowing down of the blower 12 with respect to the first mode. This reversed slow motion of the blower creates a reversed inner air curtain across the front opening 3, with the speed of about 0.3 m/sec at the inlet port 15 which is now serving as the outlet for the air curtain. On the other hand, the outer blower 6 is driven at a faster speed than in the first mode, giving the outer air curtain GA a speed of about 1.3 m/sec. It should be noted that the outer air curtain GA is now a cold curtain cooled by the outer evaporator 5. It should be recalled that the decompression valve 29 of the evaporator receives the pressurized super-cooled liquid of about 5° C. By evaporation, the decompressed refrigerant becomes a low pressure gas at about −25° C. in the evaporator.

As described above, in the third mode the cold air curtain CA formed in the first mode no longer exists. But instead the outer curtain GA is formed, having the same cold temperature and the same speed as the first mode inner curtain CA. It should be understood that this outer curtain also functions to protect the storage chamber from the ambient air during the refrigeration operation, so that the chamber may maintain its temperature unchanged. It should be appreciated that the reversed inner air curtain (formed by the reverse motion of the inner blower 12) absorbs a part of the cold outer air curtain GA into the outlet port 14 and the outer curtain GA absorbs part of the inner curtain into its inlet port 9. This results in reduction of the warm air curtain across the front opening. This also helps maintain the temperature of the chamber constant.

After the inner evaporator 11 is defrosted, a fourth mode of operation is started, in which the third electromagnetic valve 36 is closed, with the first and the second electromagnetic valves 34 and 35 kept closed. This stops the supply of the high pressure refrigerant or a defosting heat source to the inner evaporator 11. The refrigerant (which is partly a saturated gas) remaining in the evaporators 11 and 5 is now recovered through the communication pipe 33 into the liquid receiver 21 through the fourth electromagnetic valve 37, the decompression valve 29, the outer evaporator 5, the gas-liquid separator 23, the compressor 19, and the condenser 20. This fourth mode operation, meant for the recovery of the refrigerant from the defrosted inner evaporator, is called "pump down operation".

The pump down operation is given for several minutes following the third mode defrosting operation. While the refrigerant is mostly removed from the evaporators 11 and 5, part of the liquid refrigerant still remaining in the evaporators 11 and 5 evaporates and begins to cool the evaporators 11 and 5. The liquid refrigerant that passes through the outer evaporators also absorbs heat from the outer evaporator and evaporate therein, thereby cooling the outer evaporator 5 also. The blowers 6 and 12 are maintained in the same condition as in the third mode defrosting operation, since it is necessary to further dry the wet inner evaporator.

After the completion of the pump down operation the fourth electromagnetic value 37 is closed again, while the first and the second electromagnetic valves 34 and 35 are opened so that the system resumes the first refrigeration mode as indicated by the solid arrows in FIG. 2.

The inner and outer blowers 12 and 6 also return to their normal forward operations.

Figure 3:
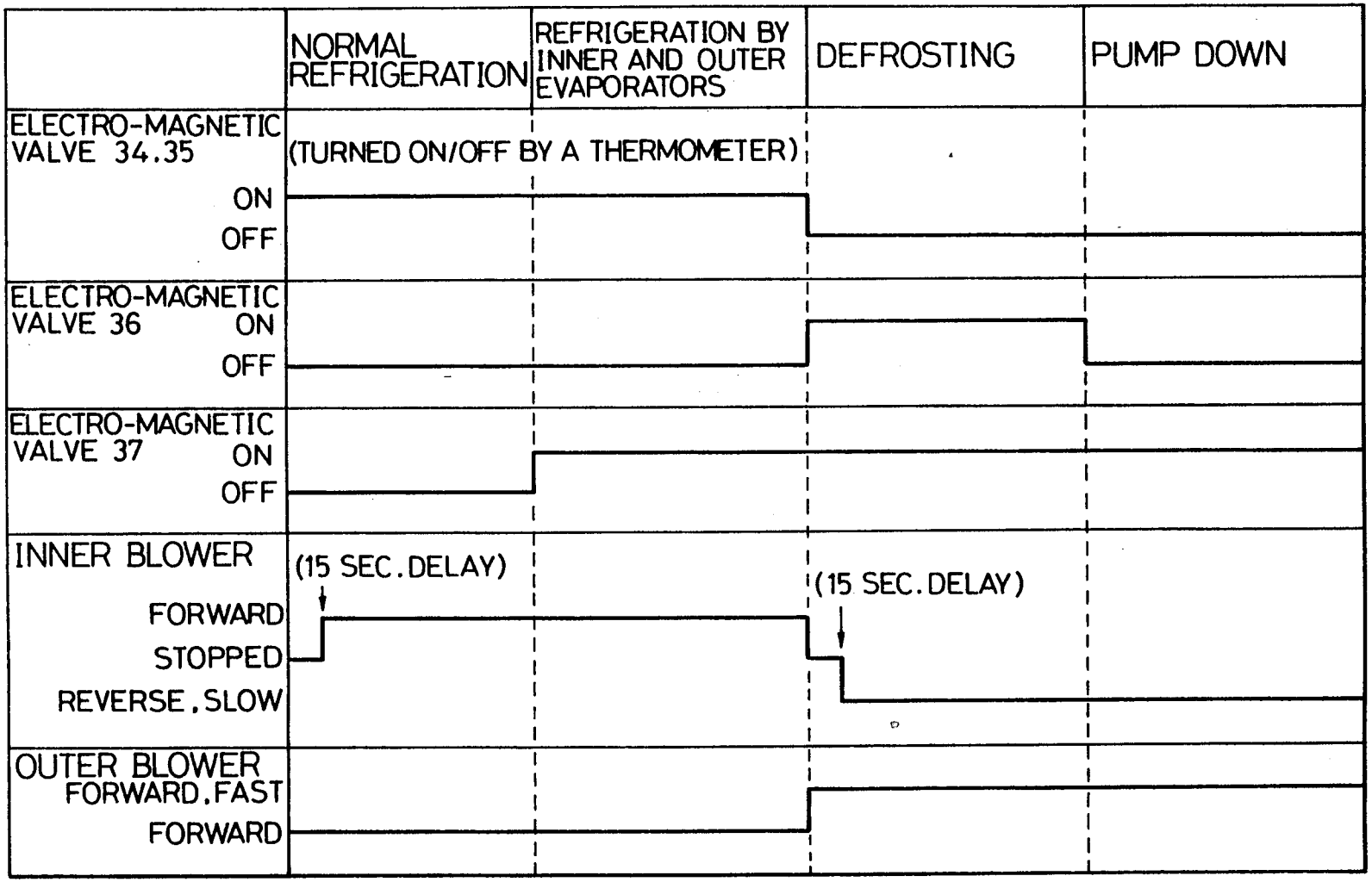
FIG. 3 is a timing chart for the refrigerant circuit.

Timing of the electromagnetic valves 34–36, and the inner and outer blowers 12 and 6, respectively, is performed as indicated in FIG. 3.

Figure 4:
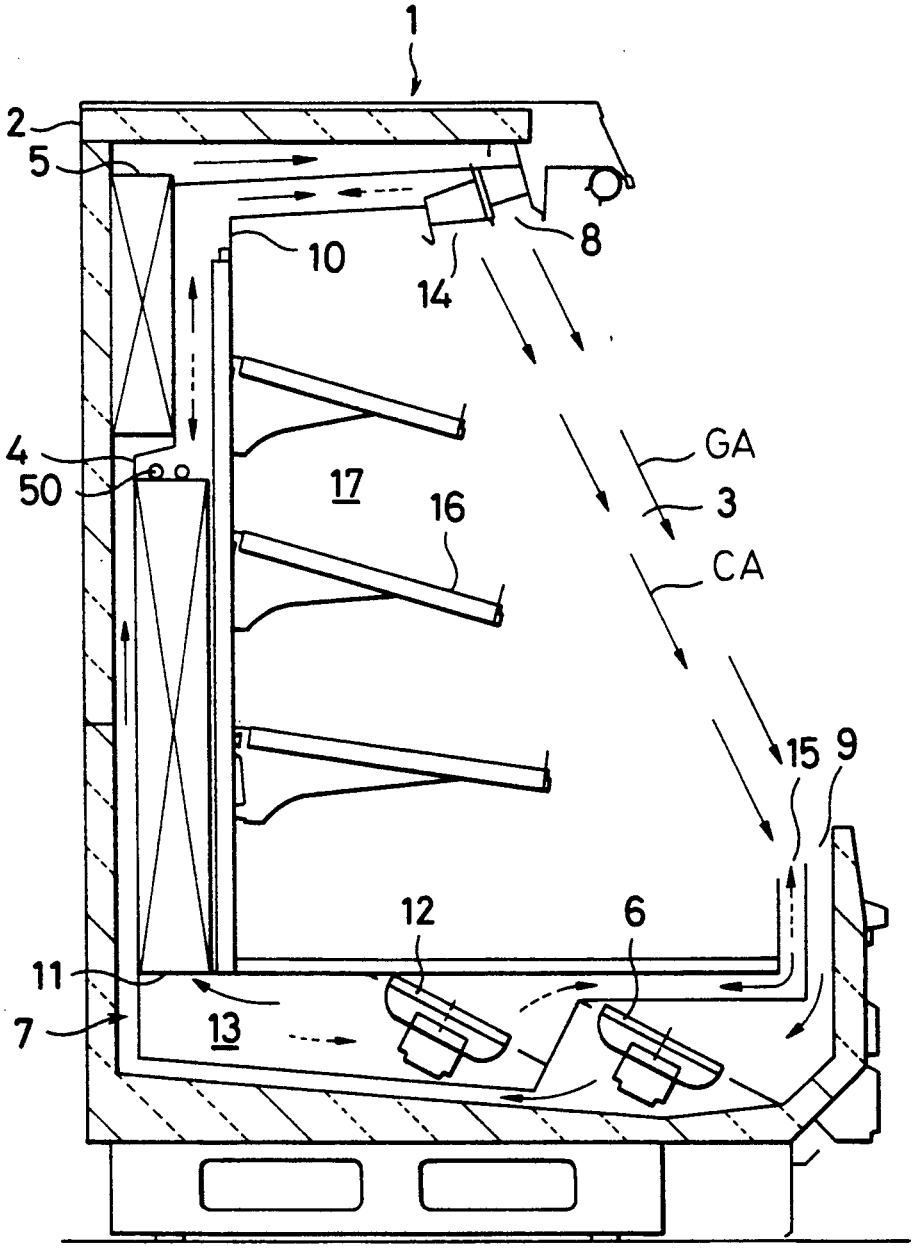
FIG. 4 is a cross sectional elevation of another open show-case embodying the invention.

The manners described above of operating the inner and outer blowers 12 and 6, respectively, may be equally utilized for an alternative open show-case having an electric heater 50 as a means for defrosting the inner evaporator 11. This is shown schematically in FIG. 4, in which elements having the same reference numerals or codes as in FIG. 2 are the same or equivalent elements. Thus, this open show-case may perform the same normal refrigeration mode as the first embodiment. During defrosting periods for the inner evaporator 11, refrigerant is passed only through the outer evaporator 5 and the inner blower 12 is reversed at a lower speed with the heater turned ON, while the outer blower 6 is operated at a higher speed. After the frost is removed by the heater 50, normal refrigeration is resumed.

We claim:

1. A method for operating an open show-case having inner and outer air ducts, a first evaporator and a first blower in said inner duct (an inner evaporator and an inner blower, respectively), and a second evaporator and a second blower in said outer duct, said blowers circulating the air to form at least two layers of air curtains running between respective upper ports at the upper end of the front opening of said show-case and respective lower ports at the lower end of said opening, comprising steps of:

providing high pressure refrigerant only through the inner evaporator via a decompression valve to thereby evaporate the refrigerant therein during refrigeration operation by the inner evaporator, without passing the refrigerant through the outer evaporator;

providing high pressure refrigerant to the inner evaporator and to the outer evaporator via a decompression valve during defrosting operation for the inner evaporator, with the outer blower driven at a higher speed than a normal speed and the inner blower driven in a reverse direction at a slower speed than a normal speed.

2. A method for operating an open show-case according to claim 1, wherein the inner blower is driven forward at a higher speed than a normal speed and the outer blower is driven forward at a lower speed than a normal speed during refrigeration operation by the inner evaporator.

3. A method for operating an open show-case according to claim 1, wherein, prior to defrosting operation for the inner evaporator, the refrigerant is passed through the inner and outer evaporators via respective decompression valves so as to effect evalpration of the refrigerant therein.

4. A method for operating an open show-case according to claim 1, further comprising steps of:

pumping down the inner and outer evaporators without supplying the refrigerant thereto after the completion of the defrosting operation for the inner evaporation, thereby recovering the liquid refrigerant remaining in the evaporators; and restarting the refrigeration by the inner evaporator following said recovery of the refrigerant from the evaporators.

* * * * *